US005617827A

United States Patent [19]

Eshleman et al.

[11] Patent Number: 5,617,827

[45] Date of Patent: Apr. 8, 1997

[54] FUEL RAIL

[75] Inventors: Edgar S. Eshleman, Bloomfield; David C. Shuler, Rochester, both of N.Y.

[73] Assignee: General Motors Corporation, Detroit, Mich.

[21] Appl. No.: 578,311

[22] Filed: Dec. 26, 1995

[51] Int. Cl.[6] ..... F02M 41/00; F02M 55/02

[52] U.S. Cl. ..... 123/456; 123/467

[58] Field of Search ..... 123/456, 467, 123/468, 469, 470, 510, 511; 138/26, 30

[56] References Cited

U.S. PATENT DOCUMENTS

| | | | |
|---|---|---|---|
| 4,615,320 | 10/1986 | Fehrenback et al. | 123/467 |
| 4,649,884 | 3/1987 | Tuckey | 123/457 |
| 4,660,524 | 4/1987 | Bertsch | 123/468 |
| 4,679,537 | 7/1987 | Fehrenbach et al. | 138/30 |
| 4,729,360 | 3/1988 | Fehrenbach et al. | 123/456 |
| 5,311,850 | 5/1994 | Martin | 123/456 |
| 5,505,181 | 4/1996 | McRae et al. | 123/456 |

*Primary Examiner*—Thomas N. Moulis
*Attorney, Agent, or Firm*—Karl F. Barr, Jr.

[57] ABSTRACT

A fuel rail for the distribution of fuel to a plurality of fuel injectors is disclosed. The fuel rail includes a longitudinal conduit having injector sockets disposed at spaced intervals and a fuel inlet. Fuel is distributed through the conduit to the various injector sockets for delivery, through associated electromagnetic fuel injectors, to the intake system of an internal combustion engine. A compliant damper is disposed in the fuel conduit and is operable to lower peak pressure pulsations initiated by the firing of the fuel injectors. The fuel damper is supported within the conduit by a keyed damper support which engages the damper. The damper support is keyed with the conduit so as to position the damper axially and rotationally within the conduit to prevent interference with fuel flow to the injector sockets.

6 Claims, 3 Drawing Sheets

FUEL RAIL

TECHNICAL FIELD

The invention relates to fuel rails for the fuel systems of internal combustion engines.

BACKGROUND

Fuel injection systems for automotive, internal combustion engines may utilize a plurality of fuel injectors, each of which delivers fuel to the inlet port of an associated engine combustion chamber. In some such systems, the fuel injectors are mounted in sockets of a fuel rail which supplies fuel to each of the injectors. The fuel rail simplifies installation of the fuel injectors, and the fuel supply assembly, to the engine.

When electromagnetic fuel injectors are employed in a system as described, the injectors deliver fuel to the engine in metered pulses which are timed to control the amount of fuel delivered and to coordinate such delivery with the operation of the engine. The sequential energization of the fuel injectors operates to induce pressure pulsations within the fuel rail which can result in fuel line hammer and fuel maldistribution within the fuel rail during operation.

In particular, with returnless fuel systems having the pressure regulator remotely located, the damper may be required to add compliance to the fuel system. Returnless systems are f increasing significance in addressing enhanced evaporative emissions standards

SUMMARY

The invention is directed to a fuel rail suitable for distributing fuel to a plurality of fuel injectors for delivery to an internal combustion engine. In the preferred fuel rail disclosed, a fuel passage is in fluid communication with a plurality of fuel injector sockets configured to receive fuel injectors therein. Disposed within the fuel passage is a fuel rail damper assembly which includes a compliant member operable to reduce peak pressure during injector firing events. The compliant member preferably includes two compliant shell halves joined about mating edges to define a sealed chamber therebetween. When joined, the mating edges of the compliant shell halves form a flange which extends about the perimeter of the compliant member. The flange engages supports which position the damper within the passage in an optimum location with respect to the fuel injector sockets.

The details of the preferred embodiment of the invention as well as other features and advantages are set forth in the following detailed description and drawings.

DESCRIPTION OF THE PREFERRED EMBODIMENT

Figure 1:
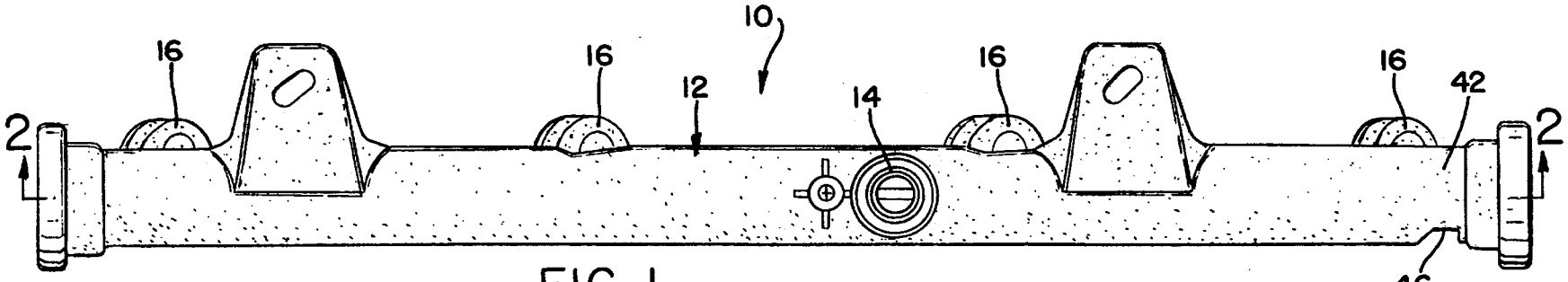
FIG. 1 is a plan view of a fuel rail, for use on an internal combustion engine.
Figure 2:
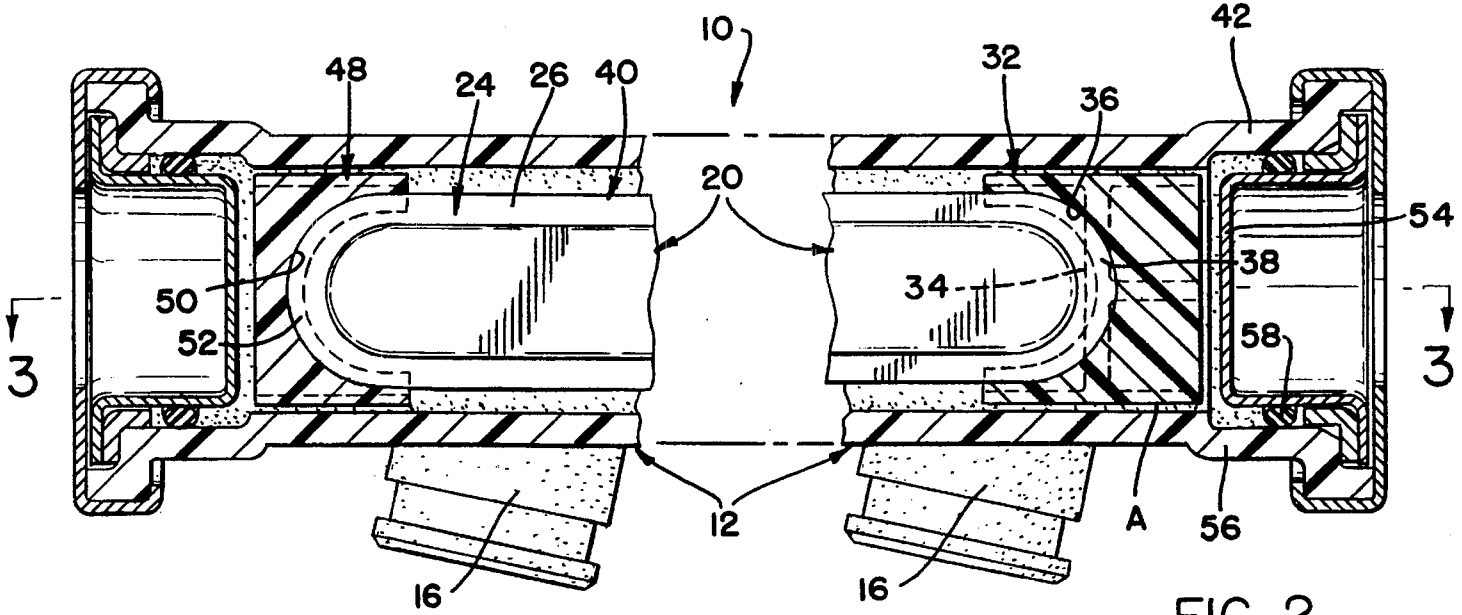
FIG. 2 is a partial, cross sectional view of the fuel rail of FIG. 1, taken along line 2—2 of FIG. 1.
Figure 3:
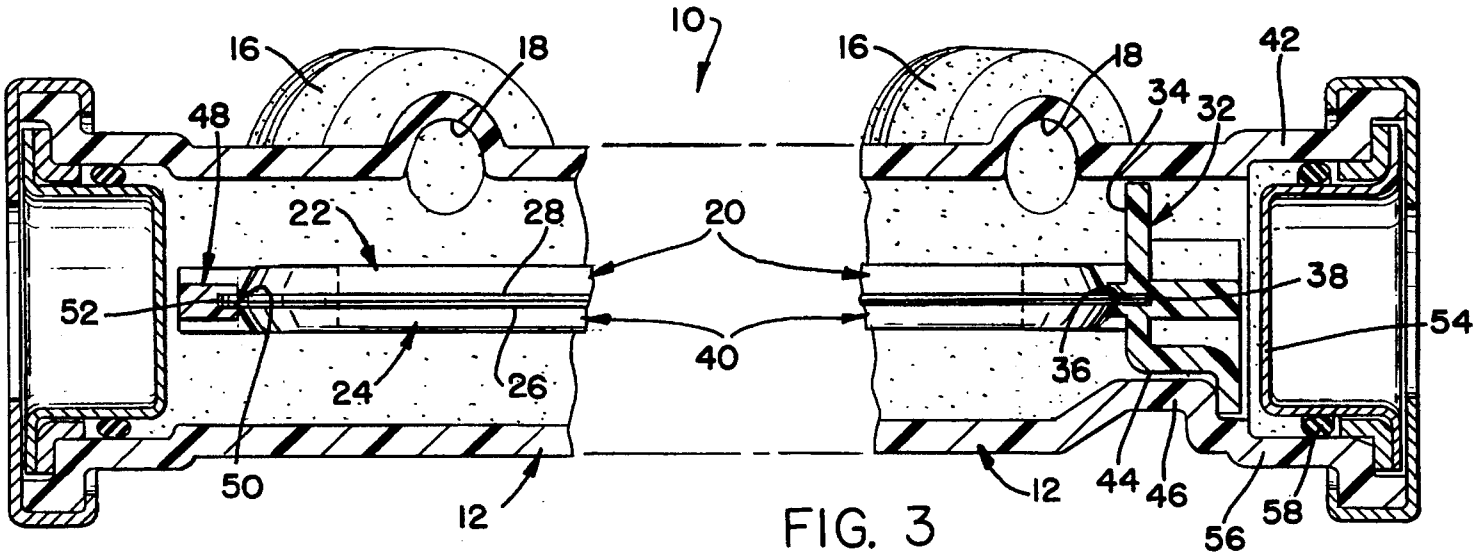
FIG. 3 is a partial, cross sectional view of FIG. 1, taken along line 3—3 of FIG. 2.

Referring to FIGS. 1–3, fuel rail 10 includes a longitudinally extending fuel supply conduit 12 which receives fuel from a fuel line (not shown) connected to an inlet 14. In the embodiment shown, the fuel rail 10 and its associated conduit 12 is constructed as a molded plastic tubular member however, the construction material for the fuel rail may vary. A plurality of fuel injector sockets 16 extend from the exterior of fuel rail and have openings 18, FIGS. 3 and 5, which extend through the wall of the rail to intersect the fuel supply conduit 12 to supply fuel to each socket 16 and its associated fuel injector, not shown. The fuel injectors are preferably conventional electromagnetic fuel injectors energized by a conventional electronic control unit to deliver timed pulses of fuel for mixture with air flowing through an engine inlet port.

Figure 4:
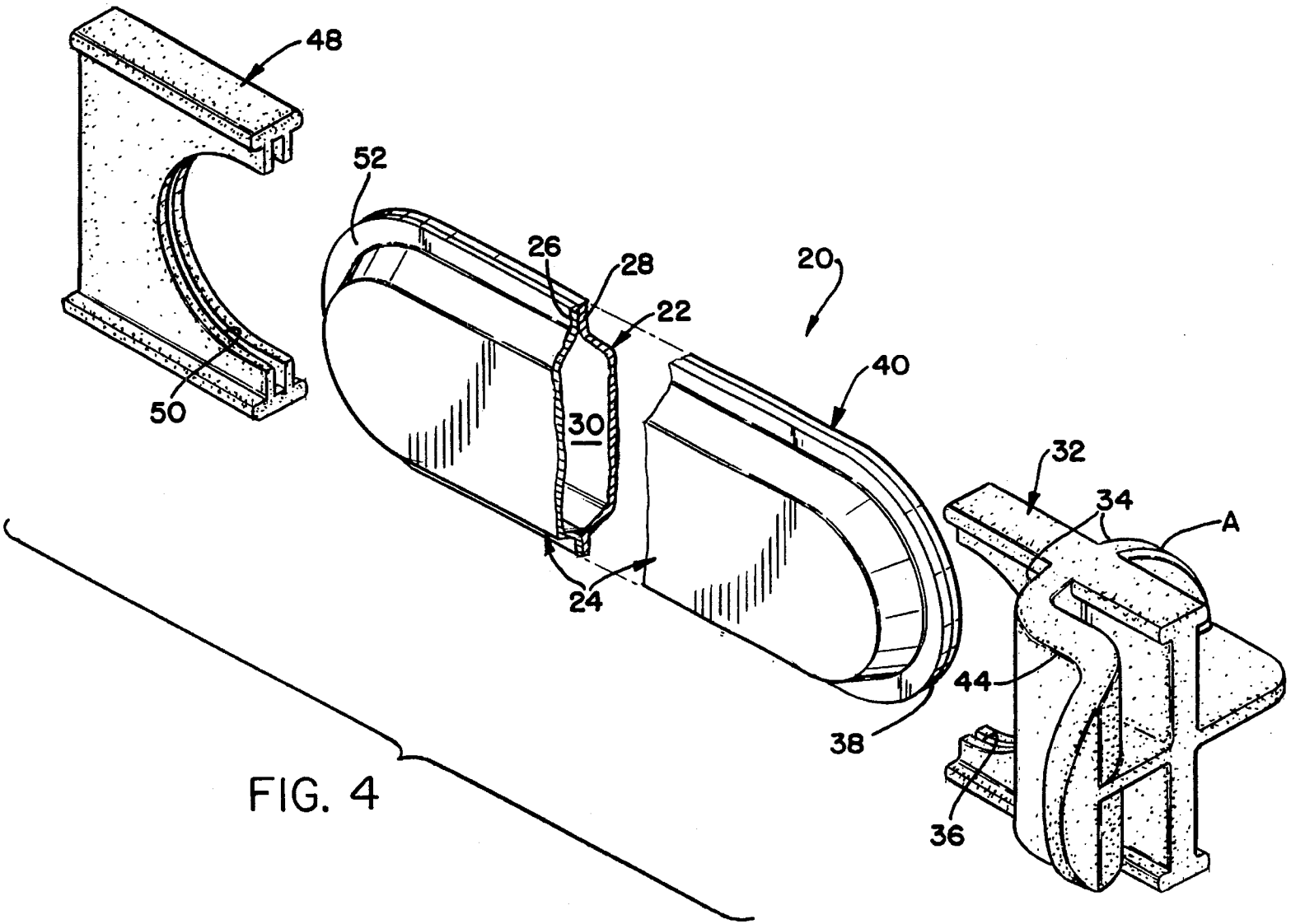
FIG. 4 is a disassembled view, partially in section, of the fuel rail damper assembly of the present invention.

Disposed within the fuel conduit 12 is a fuel rail damper 20, shown in detail in FIG. 4, which operates to minimize incidences of fuel line hammer and resultant fuel maldistribution by reducing the peak pressure within the conduit during injector firing events. The fuel rail damper 20 includes first and second shell halves 22 and 24, respectively. The shell halves 22 and 24 mate with one another along flanged perimeters 26 and 28 and are subsequently welded or otherwise fixed permanently to define a flanged perimeter 40 and an enclosed airspace 30 which, when disposed within fuel rail conduit 12, operates as a compliant member to reduce peak pressure pulsations generated by the opening and closing of the fuel injectors.

Positioning of the fuel rail damper 20 within the fuel conduit 12 is essential for proper distribution of fuel to each of the openings 18 and their respective sockets 16. Placement of the damper closely adjacent to an opening 18 will adversely affect the flow of fuel to that opening. A first, keyed damper support 32 has a conduit face 34 oriented towards the interior of the fuel rail conduit 12 and includes a support slot 36 in which a first end portion 38 of the flanged perimeter 40 of the damper is slidingly disposed. The keyed damper support 32 defines a circumference "A", see FIGS. 2 and 4, having an outer dimension which is slightly less than the inner circumference of the fuel conduit 12 allowing a sliding fit of the keyed damper support 32 into a first end 42 of the fuel conduit 12. The keyed damper support operates, with respect to the first end 42 of the fuel conduit 12 to position the fuel rail damper 20 diametrically within the fuel conduit, FIGS. 2 and 3, through the action of the support slot 36. To prevent rotation of the damper 20 within the fuel conduit 12 the keyed damper support 32 includes a slot or keyway 44 which engages a positioner such as orientation flat 46 in the circumference of the fuel conduit 12. The flat 46 functions with the keyway 44 to prevent rotation of the damper support 32 within the fuel conduit 12.

A second damper support 48 includes a support slot 50 in which a second end portion 52 of the flanged perimeter 40 of the damper is disposed. The second damper support 48 extends diametrically across the interior of the fuel conduit 12 to support the second end 52 of the fuel rail damper 20 therein. In the embodiment shown in FIGS. 2 and 3, the second damper support 48 has a diametrical dimension which is only slightly less than that of the conduit inner circumference allowing a sliding fit of the damper support so as to maintain the second end 52 of the fuel rail damper 20 in spaced relationship with the inner surface of the conduit 12. Damper supports 32 and 48 are configured to engage and provide support for fuel rail damper 20 throughout the allowable range of component dimensional variation.

Installation of the fuel rail damper assembly into the fuel rail conduit is preferably through first end 42. First and second damper supports 32 and 48 are assembled onto the first and second ends 38 and 52 of the fuel rail damper 20 and the second end of the damper with the damper support 48 attached is inserted axially through the first end 42 of the conduit 12 until the keyway 44 of damper support 32 engages the orientation flat 46 on the inner surface of the fuel conduit 12 to locate the damper both axially and rotationally and to position the damper optimally with respect to the injector socket ports 18.

Closure of the first end 42 of the fuel rail conduit 12 may be through the use of end plug 54 which is positioned within the rail end flange 56 and which is operable to maintain the keyed damper support 32 and associated damper assembly 20 axially positioned within the conduit 12. A resilient sealing member such as o-ring 58 is located between the end plug 54 and rail end flange 56 to maintain a leak-tight seal therebetween. The end construction of the fuel rail 10 may vary substantially from that described, dependent upon the method and material of tube construction.

Figure 5:
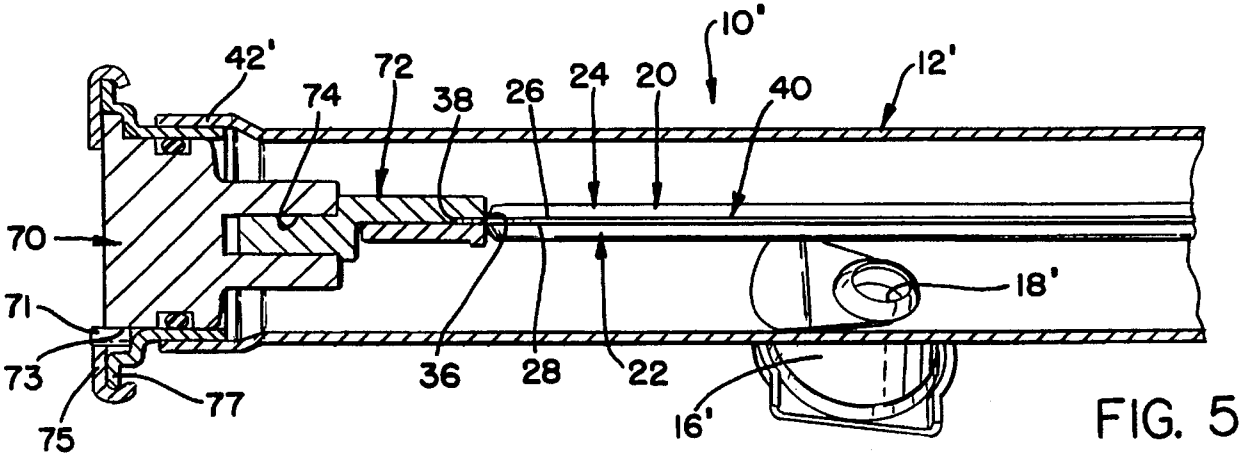
FIG. 5 is a partial, cross sectional view of a fuel rail illustrating a second embodiment of the present invention.

In the alternate embodiment 10' of FIG. 5, in which like features as those described with respect to the above embodiment are indicated with similar numerals having a primed designation, the damper support 72 is integrated into the fuel conduit end plug 70 with the keyed end plug at first end 42' of conduit 12' providing the diametrical, rotational and axial positioning function relative to the longitudinal fuel supply conduit 12' through a tab or pin 71 which is pressed into opening 73 of end plug 70. The plug 70 and pin 71 are axially retained within rail 12' by end cap 75 which may be crimped onto rail end flange 77. In the embodiment, the damper support 72 continues to include a slotted opening 36' for slidingly receiving the flanged portion 38 of the fuel rail damper 20. The end plug 70, includes a second slotted opening 74 which receives the damper support 72 therein. It should be noted that in the embodiment of FIG. 5, the damper support 72 may be molded or otherwise constructed as an integral portion of the end plug 70, thereby dispensing with multiple parts.

In the case of fuel rails having conduits with varying internal dimensions, the second, damper support 48 may have a diametrical dimension which is only slightly less than that of the smallest cross section of the fuel supply conduit 12', allowing axial passage through the length of the conduit. The diametrical dimension of the damper support 48 will, in such a case, continue to provide support within the conduit 12' through single sided contact with the inner wall of the conduit, to thereby maintain the second end 52 of the damper 20 in spaced relationship with the inner surface of the conduit 12'.

The present invention provides a fuel rail assembly for application in the fuel systems of internal combustion engines including a compliant fuel damper which is operable to reduce the peak pressure in the rail during injector firing events. The damper is oriented within the fuel rail to optimize the effectiveness of the damper to reduce pressure pulsations which can result in fuel line hammer and rail maldistribution during operation. A keyed damper support axially and rotationally orients the damper to a mating feature in the fuel rail, such as a flat or a locator tab. At the opposite end of the damper, a second support maintains the damper in a spaced relationship to the injector socket ports. Both of the damper supports are pressed on to the ends of the damper and, in a preferred embodiment, slidingly engage a peripheral flange on the damper. The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described were chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. A fuel rail assembly comprising a fuel conduit having first and second ends, an inlet for receiving fuel and a fuel injector socket extending from said fuel conduit and including an injector port intersecting said fuel conduit for conducting fuel from said conduit to said fuel injector socket, said fuel rail assembly further comprising a compliant damper assembly constructed of first and second halves joined along a peripheral flange to thereby define an air space between said halves, a first, keyed damper support located at a first end of said compliant damper, said keyed damper support including a support slot configured to receive said peripheral flange to support said compliant damper in said fuel conduit and an outer circumference configured for sliding insertion into said first conduit end, said outer circumference having a keyway for engagement with a corresponding positioner in said conduit, said keyed damper support operable to position said damper axially and rotationally within said fuel conduit.

2. A fuel rail assembly, as defined in claim 1, further comprising a second damper support including a support slot configured to receive said peripheral flange for support of said compliant damper in said fuel conduit, said second damper support extending diametrically within said fuel conduit to support said compliant damper through contact with said conduit.

3. A fuel rail assembly, as defined in claim 2, said second damper support configured to pass through said fuel conduit from said first end to said second end.

4. A fuel rail assembly comprising an axially extending fuel conduit, said conduit including first and second ends, an inner wall extending axially from said first to said second end, an inlet for receiving fuel from a source and a fuel injector socket extending from said conduit and surrounding an injector port, said injector port intersecting said fuel conduit for the transfer of fuel from said conduit to said fuel injector socket, said fuel rail assembly further comprising a compliant damper assembly having a closed member defining an air space and having a flange member extending therefrom, a damper support configured to receive said flange to support said compliant damper in said fuel conduit, and locating features for axially and rotationally positioning said damper support within said conduit.

5. A fuel rail assembly, as defined in claim 4, said closed member comprising first and second clamshell members joined along edges of said members to define said air space therebetween.

6. A fuel rail assembly, as defined in claim 4, wherein said damper support comprises an end cap for closing said first end of said axially extending conduit.

* * * * *